US006963057B1

(12) United States Patent
Swanger et al.

(10) Patent No.: US 6,963,057 B1
(45) Date of Patent: Nov. 8, 2005

(54) SIMULTANEOUS INDUCTION HEATING OF MULTIPLE WORKPIECES

(75) Inventors: Wallace Shane Swanger, Pleasant Grove, UT (US); Edward J. Rylicki, Utica, MI (US); Oleg S. Fishman, Maple Glen, PA (US)

(73) Assignee: Inductotherm Corp., Rancocas, NJ (US)

( * ) Notice: Subject to any disclaimer, the term of this patent is extended or adjusted under 35 U.S.C. 154(b) by 0 days.

(21) Appl. No.: 10/418,407

(22) Filed: Apr. 18, 2003

Related U.S. Application Data

(60) Provisional application No. 60/374,065, filed on Apr. 19, 2002.

(51) Int. Cl.[7] ..... H05B 6/40

(52) U.S. Cl. ..... 219/653; 219/656; 219/672; 219/637; 148/567

(58) Field of Search ..... 219/653, 654, 219/655, 656, 657, 658, 650, 647, 637, 646, 219/667, 672; 148/567–573; 266/129; 373/142–145

(56) References Cited

U.S. PATENT DOCUMENTS 4,315,124 A * 2/1982 Granstrom et al. ..... 219/656
4,407,486 A * 10/1983 Mills et al. ..... 266/129
5,844,213 A * 12/1998 Peysakhovich et al. ..... 219/672
5,922,234 A * 7/1999 Grow et al. ..... 219/645

* cited by examiner

*Primary Examiner*—Philip H. Leung
(74) *Attorney, Agent, or Firm*—Philip O. Post

(57) ABSTRACT

Multiple workpieces are inductively heated by passing them through one or more induction heating coils. Passage of a section of each workpiece through a coil may oscillate in the forward and reverse directions, independent of the movement of the other workpieces, one or more times, to selectively heat each workpiece while operating the power supplies for each of the induction heating coils at constant current, voltage and/or power to maximize the efficiency of the electrical circuit and minimize the requirements for power supply control circuitry.

4 Claims, 2 Drawing Sheets

SIMULTANEOUS INDUCTION HEATING OF MULTIPLE WORKPIECES

CROSS REFERENCE TO RELATED APPLICATIONS

This application claims the benefit of U.S. Provisional Application No. 60/374,065, filed Apr. 19, 2002.

FIELD OF THE INVENTION

The present invention relates to simultaneous induction heating of multiple workpieces wherein the degree of heating of each workpiece can be varied.

BACKGROUND OF THE INVENTION

U.S. Pat. No. 5,844,213 (the 213 patent), titled Induction Heating Coil Assembly for Prevention of Circulating Currents in Induction Heating Lines for Continuous-Cast Products, discloses an induction heating coil assembly 24 that is used to inductively heat a single slab 26 as it passes through the coil assembly on conveyor rolls 27 and 29.

The disadvantage of the roller induction heating line in the 213 patent is that it is used to heat only one slab, or other workpiece, at a time. Therefore there is the need for an induction heating line that will heat multiple workpieces at the same time, and will allow each of the multiple workpieces to be inductively heated to varying degrees with use of one or more induction heating coil assemblies for all of the workpieces.

BRIEF SUMMARY OF THE INVENTION

In one aspect, the present invention is an apparatus for and method of simultaneously induction heating of multiple workpieces to different temperatures with one or more induction heating coil assemblies through which the workpieces pass in an oscillatory forward and reverse motion as required to inductively heat each workpiece to the required temperature. These and other aspects of the invention are set forth in the specification and claims.

BRIEF DESCRIPTION OF THE DRAWINGS

The figures, in conjunction with the specification and claims, illustrate one or more non-limiting modes of practicing the invention. The invention is not limited to the illustrated layout and content of the drawings.

FIG. 1(*b*) is a plan view illustrating the arrangement of apparatus of the present invention in FIG. 1(*a*) for simultaneous induction heating of multiple workpieces with multiple workpieces typically positioned on the apparatus.

DETAILED DESCRIPTION OF THE INVENTION

Figure 1A:
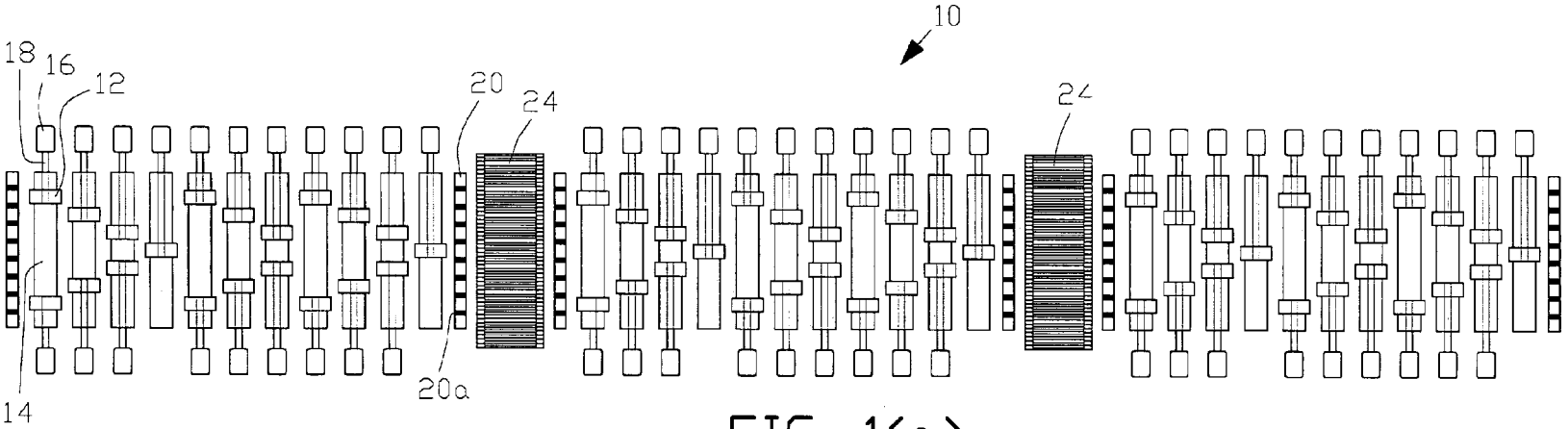
FIG. 1(*a*) is a plan view illustrating one arrangement of apparatus of the present invention for simultaneous induction heating of multiple workpieces.
Figure 1B:
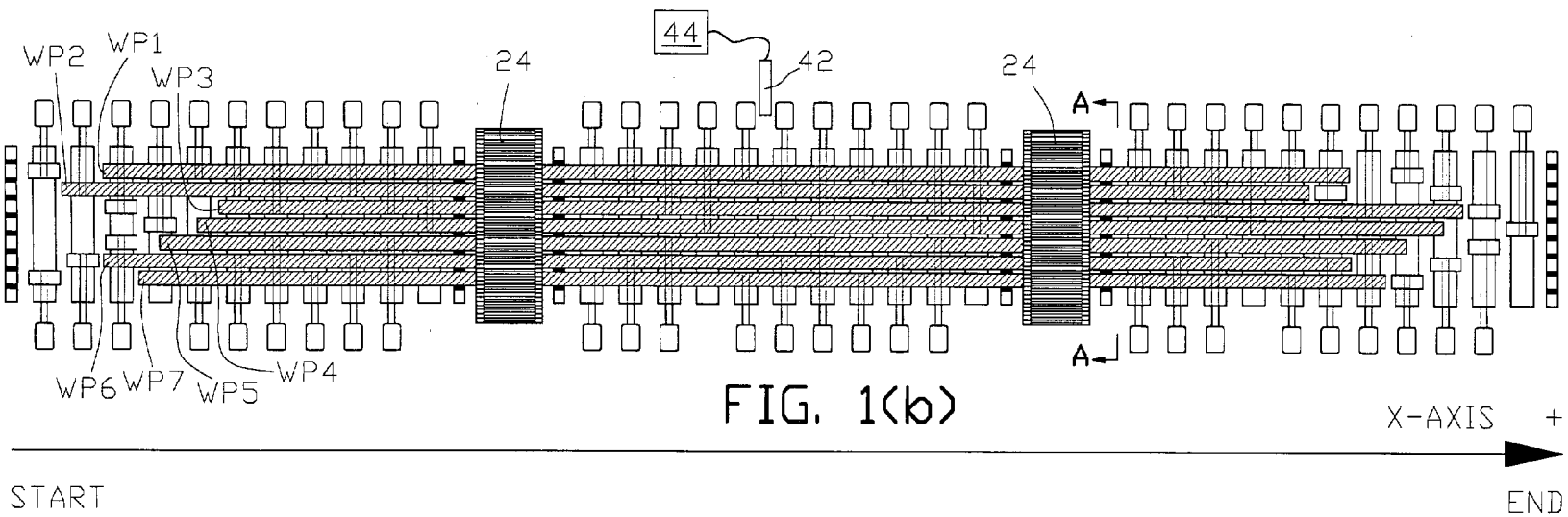

Referring now to the drawings, wherein like numerals indicate like elements, there is shown in FIG. 1(*a*) and FIG. 1(*b*) one example of apparatus 10 of the present invention for simultaneous induction heating of multiple workpieces. Previously mentioned U.S. Pat. No. 5,844,213 (the 213 patent) is incorporated herein by reference in its entirety. For apparatus 10 in FIG. 1(*a*) and FIG. 1(*b*), a non-limiting number of two induction heating coil assemblies 24 are used. Each induction heating coil assembly may be, but is not limited to, the induction heating coil assembly as disclosed in the 213 patent. Conveyor means for each of the multiple workpieces in this example of the invention comprises a plurality of rollers 12 arranged among a plurality of support structures 14. Each of the rollers is suitably connected to the support structure to provide for independent rotational movement of each roller relative to the support structure. The use of rollers is not a limiting type of conveyor means for practicing the invention, as long as the conveyor means can move a workpiece in the positive (forward) and negative (reverse) directions along the X-axis (i.e. in the forward or reverse directions through each of the induction heating coil assemblies). Each roller 12 is connected to a drive means 16 via suitable connecting means 18. Suitable, but not limiting, drive means can be a reversible electric motor drive. Suitable, but not limiting, connecting means 18 is a drive shaft connected at one end to the output of the drive means, and at the other end, to the associated roller, whereby the drive means can drive the associated roller in a circular motion that is either clockwise or counterclockwise. Guide means 20 can be used at various locations along the heating line to keep each of the multiple workpieces in alignment on its conveyor means as it moves in the forward and reverse directions along the X-axis through the induction heating coil assemblies.

Figure 4:
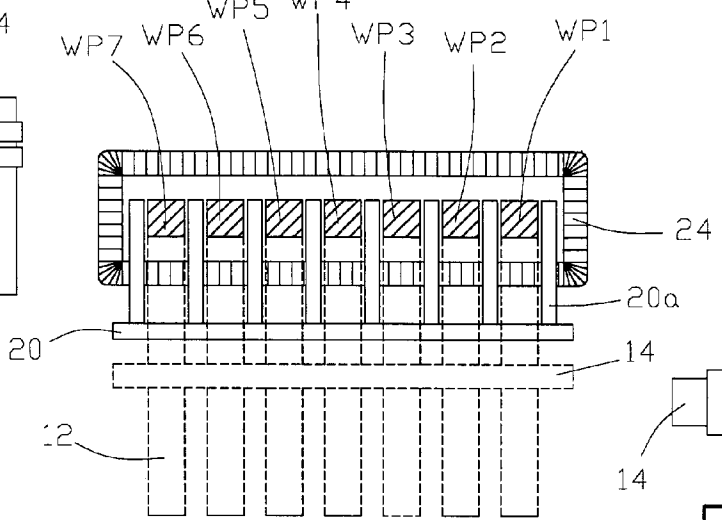
FIG. 4 is an elevational sectional view through line A—A in FIG. 1(*b*) of an induction heating coil assembly and multiple workpieces.

FIG. 1(*b*) is apparatus 10 of FIG. 1(*a*) with an exemplary seven multiple workpieces, WP1 through WP7 (shown crosshatched), typically illustrated as they are being inductively heated by apparatus 10. FIG. 4 is a sectional view of the workpieces at the exit end of the second induction heating coil assembly 24. In this example, each workpiece enters apparatus 10 at the location labeled START along the X-axis in FIG. 1(*b*). The series of aligned rollers 12 under a particular workpiece, defined as a workpiece roller track, advances the workpiece through apparatus 10 until it exits at the location labeled END. Each workpiece does not necessarily travel only in the positive direction along the X-axis as it moves through the apparatus. Each workpiece may move back and forth in the positive and negative directions along the X-axis by clockwise or counterclockwise rotation of rollers 12 that make up the workpiece's roller track and upon which the workpiece travels. By moving a section of a workpiece back and forth through one of induction heating coil assemblies 24, a selective degree of heating of each individual workpiece can be achieved. If desired, a varied induction heating profile along the length of a workpiece can be achieved by varying the amount of time that a section of the workpiece passes through one of the two induction heating coil assemblies. This oscillatory movement of the workpiece piece through apparatus 10 minimizes the longitudinal lengths and quantities of each induction heating coil assembly 24. Guide means 20 may comprise a series of vertical spacers 20*a* that form a chute, or guide path, through which each workpiece will be guided as it oscillates through apparatus 10. Because of the use of independent drive means for the conveyor means associated with each roller in the roller track for each of the multiple workpieces, each workpiece can be subjected to different degrees of induction heating with the use of apparatus 10. This is advantageous, for example, when workpieces are of different compositions, or sizes, and require different degrees of induction heating. For example at any given time, multiple workpieces WP1 through WP7 may be a mix of: stainless steel bars that require heating to 2,400° F.; nickel alloy bars that require heating to 2,125° F.; and titanium alloy bars that require heating to 1,750° F. With the ability to independently oscillate each bar along the positive and negative X-axis as it progresses through apparatus 10, each of the induction heating coil assemblies can be operated at constant input current, voltage and/or power to optimize the electrical efficiency of each coil and power supply circuit, and to eliminate electrical control circuitry associated with a coil operating at a variable current, voltage and/or power to achieve varying degrees of induction heating as a workpiece passes through it. The varying and alternating forward and reverse movement of each workpiece along its longitudinal axis through each of the induction heating coil assemblies controls the degree of induction heating of the workpiece along its longitudinal axis.

Figure 2:
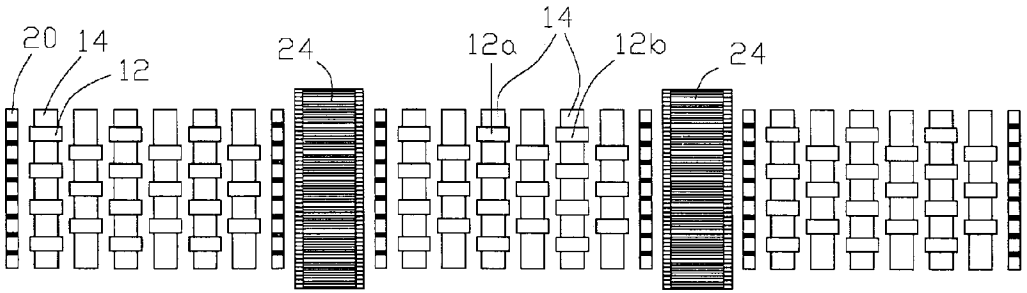
FIG. 2 is a plan view illustrating another arrangement of apparatus of the present invention for simultaneous induction heating of multiple workpieces.

FIG. 2 illustrates another arrangement for apparatus of the present invention for simultaneous induction heating of multiple workpieces wherein, for each of the multiple workpieces, adjacent rollers associated with each workpiece, for example, rollers 12*a* and 12*b* in FIG. 2, are spaced equally apart along the heating line (one support structure 14 constant spacing distance). Quantities, arrangement and spacing of rollers for a particular application will vary depending upon factors such as the rigidity of the workpiece (supporting function of the rollers) and the speed (friction and workpiece loading on the rollers) at which the workpiece oscillates through the apparatus.

Figure 5:
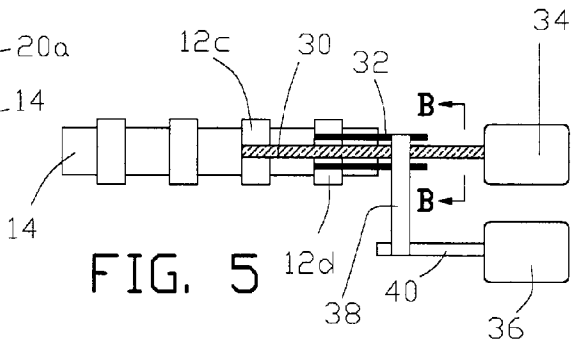
FIG. 5 illustrates one method of driving conveyor means used with the apparatus of the present invention for simultaneous induction heating of multiple workpieces.
Figure 6:
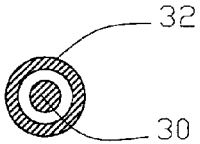
FIG. 6 is a side sectional view through line B—in FIG. 5 of drive shafts for conveyor means used with apparatus of the present invention for simultaneous induction heating of multiple workpieces.

FIG. 5 and FIG. 6 illustrate one method of independently driving multiple rollers on the same supporting structure 14. Concentric drive shafts 30 and 32 are connected at one end to rollers 12*c* and 12*d*, respectively. At the opposing end, shafts 30 and 32 are connected to drive means 34 and 36, respectively. In this particularly arrangement, connecting means 38, such as a belt or chain, connects the outer concentric shaft 32 to the output shaft 40 of drive means 36. With this arrangement, drive means 34 independently drives roller 12*c* associated with a first workpiece and drive means 36 independently drives roller 12*d* associated with a second workpiece.

Figure 3:
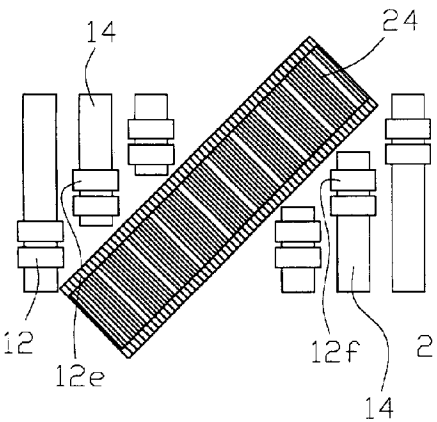
FIG. 3 is a plan view illustrating another arrangement of apparatus of the present invention for simultaneous induction heating of multiple workpieces.

For the non-limiting examples of apparatus 10 in FIG. 1(*a*) and FIG. 2, the transverse width of each induction heating coil assembly is aligned substantially normal to the longitudinal axis of each workpiece and the direction of travel of each workpiece. Skewing the transverse width of induction heating coil assembly 24 relative to the direction of travel of the workpiece as illustrated in FIG. 3 will maximize the volume of a workpiece that is within the coil assembly at any given time, and consequently, will maximize the volume of the workpiece being inductively heated at any given time. While this will skew the magnetic field generated in the coil relative to the longitudinal length of a workpiece and establish both transverse and longitudinal eddy current paths in the workpiece, adjacent rollers for the same workpiece, such as rollers 12*e* and 12*f* in FIG. 3, may optionally be electrically isolated from each other to eliminate the possibility of any stray current paths. In some examples of the invention, a combination of skewed and normally oriented induction heating coil assemblies may be used.

While each roller in a roller track for a particular workpiece in the above examples has an independent drive means, two or more of the rollers in the roller track for a particular workpiece may be interconnected to a common drive means.

In any example of the present invention, all independent drive means may be controlled by a computer system comprising one or more processors. The processor may output forward and reverse drive signals to each drive means to control the oscillatory motion of each workpiece. The oscillations (number, distances and speed) that a particular workpiece will be subjected to may be controlled by a computer program executed by the processor, or, optionally, with operator input to the computer system. Each oscillation program for a particular type of workpiece may be stored in a memory component in the computer system and executed by the processor for a particular workpiece and induction heating requirements. Optionally the computer system may further comprise workpiece speed and position sensors, such as laser beams, and/or temperature sensors, such as pyrometers, that are positioned along the induction heating line. The output of these sensors can be inputted to the computer system so that the oscillations can be adjusted for real time heating control of each workpiece. For example as shown in FIG. 1(*b*), temperature sensor 42 can provide an input to processor 44 as to the temperature of workpiece WP1 along its length as it moves past the temperature sensor. The processor, based upon a comparison of the sensed temperature and desired temperature of workpiece WP1 at that point in the process, can output a signal to drive means 16 for workpiece WP1 to alter the oscillatory forward and reverse movement of workpiece WP1 through the induction heating coil assemblies. Further the computer system may be integrated with a workpiece loading system wherein the workpiece loading system will selectively load the next workpiece to be heated on to a roller track that will maximize throughput of workpieces based upon the time that a particular workpiece spends on the roller track in apparatus 10 for the required heating.

Although a rectangular bar workpiece is illustrated in the above examples, the shape of the workpiece is not limiting to the invention. For example the workpieces may be of tubular construction. Further all of the multiple workpieces need not be of the same dimensions or types. The above examples are illustrative of the invention and does not limit the number of induction heating coil assemblies and multiple workpieces that may be simultaneously heated in an apparatus of the present invention.

The foregoing embodiments do not limit the scope of the disclosed invention. The scope of the disclosed invention is further set forth in the appended claims.

What is claimed is:

1. An apparatus for simultaneously induction heating an at least two elongated workpieces adjacently disposed to each other, the apparatus comprising an at least one induction heating coil assembly wherein the transverse axis of at least one of the at least one induction heating coil assembly is skewed to the longitudinal axis of each of the at least two elongated workpieces; and a conveyor means for independently moving each one of the at least two elongated workpieces through each of the at least one induction heating coil assembly in varying and alternating forward and reverse directions along the longitudinal axis of each of the at least two workpieces, wherein the conveyor means comprises a plurality of rollers for each of the at least two workpieces, each of the plurality of rollers connected to a drive means for selectively rotating each of the plurality of rollers in the clockwise or counterclockwise directions to independently move each of the at least two elongated workpieces through the at least one induction heating coil assembly, wherein each of the plurality of rollers are rotationally connected to a common support structure, and each of the plurality of rollers are independently rotationally-driven by a drive means, the drive means connected to each of the plurality of rollers by an inner and outer concentric shaft, respectively, the inner and outer shafts coaxially disposed within the common support structure.

2. The apparatus of claim 1 wherein adjacent ones of the plurality of rollers moving each of the at least two elongated workpieces through the at least one of the at least one induction heating coil assembly having a skewed transverse axis are electrically isolated from each other.

3. A method of simultaneously induction heating an at least two elongated workpieces, the method comprising the steps of providing an at least one induction heating coil assembly having its transverse axis skewed to the longitudinal axis of each of the at least two elongated workpieces, and independently moving each one of the at least two elongated workpieces through each of the at least one induction coil assembly in varying and alternating forward and reverse directions along the longitudinal axis of each of the at least two workpieces; providing a plurality of rollers for independently moving each one of the at least two elongated workpieces through each of the at least one induction coil assembly in varying and alternating forward and reverse directions along the longitudinal axis of each of the at least two elongated workpieces, rotationally mounting at least one of the plurality of rollers for at least two of the at least two elongated workpieces on a common structural support, providing a driver means for each of the plurality of rollers on a common structural support, and connecting the driver means for each of the plurality of rollers by an inner and outer concentric shaft, respectively, the inner and outer shafts coaxially disposed within the common structural support.

4. A method of simultaneously induction heating an at least two elongated workpieces, the method comprising the steps of providing an at least one induction heating coil assembly having its transverse axis skewed to the longitudinal axis of each of the at least two elongated workpieces, and independently moving each one of the at least two elongated workpieces through each of the at least one induction coil assembly in varying and alternating forward and reverse directions along the longitudinal axis of each of the at least two workpieces; providing a plurality of rollers for independently moving each one of the at least two elongated workpieces through each of the at least one induction coil assembly in varying and alternating forward and reverse directions along the longitudinal axis of each of the at least two elongated workpieces, and electrically isolating adjacent ones of the plurality of rollers moving each of the at least two elongated workpieces through the at least one of the at least one induction heating coil assembly having a skewed transverse axis.

* * * * *